US005326136A

United States Patent [19]

Doyle

[11] Patent Number: 5,326,136

[45] Date of Patent: Jul. 5, 1994

[54] CHECK BOOK WITH FORGERY AND THEFT INHIBITING FEATURES

[76] Inventor: Lawrence R. Doyle, P.O. Box 3172, Wrightwood, Calif. 92397

[21] Appl. No.: 45,641

[22] Filed: Apr. 12, 1993

[51] Int. Cl.[5] ..... B42D 15/00

[52] U.S. Cl. ..... 283/58; 281/15.1; 283/57

[58] Field of Search ..... 283/57, 58, 59, 62, 283/117, 36–43; 281/2, 15.1, 21.1

[56] References Cited

U.S. PATENT DOCUMENTS

| | | | |
|---|---|---|---|
| 1,564,482 | 12/1925 | Hjul | 283/58 |
| 1,835,909 | 12/1931 | Shoemaker | 281/15.1 |
| 2,046,151 | 6/1936 | Davis et al. | 281/15.1 |
| 2,310,725 | 2/1943 | Widder et al. | 281/15.1 |

*Primary Examiner*—Mark Rosenbaum

*Assistant Examiner*—Willmon Fridie, Jr.

*Attorney, Agent, or Firm*—Macro-Search Corp.

[57] ABSTRACT

A check book is disclosed which includes checks arranged such that if any one or more of the checks is removed from the check book other then the top, or next check, a stripe printed on a subsequent check will become visible, thus warning that the check has been removed out of turn. An invisible authenticating signature is placed on each check. This can be easily rendered visible after the check is signed. The comparison of the two signatures provides a means for identifying a forgery. A set of symbols are printed on the face of the check. When cashing the check, the bearer may select certain of the symbols. This selection may be compared with a similar set previously chosen by the account holder to assure a bank teller that the bearer is in fact the true account holder.

8 Claims, 3 Drawing Sheets

CHECK BOOK WITH FORGERY AND THEFT INHIBITING FEATURES

FIELD OF THE INVENTION

This invention relates generally to checks and other financial instruments used in the field of banking, and more particularly to an account holder's bankbook having features providing for the early identification of a missing check taken from the bankbook, as well as means for assuring the authenticity of the writer of checks taken from the bankbook.

BACKGROUND OF THE INVENTION

There is clearly a need for improved security in the field of banking especially with respect to consumer accounts. Protection against fraud, misidentification, loss and other problems in consumer finance present a significant financial burden and inconvenience to banks, retailers, and consumers alike.

Consumer check writing practise has not changed to any appreciable extent for over one hundred years, except that the number of persons writing checks continues to grow at an exponential rate. The problem of controlling such a massive funds handling industry is great. The cost of security in the banking industry is part of the total cost that all must pay to assure that the system is viable.

Consumer check books are protected by the mechanisms of providing pre-numbered checks, watermarks printed name, address and phone number, and the magnetically readable codes on the check face. There is currently no protection in the check book for early identification of a missing blank check taken from the checkbook. Of course, early identification is the best defense against fraud. Also, there is no way for a merchant to know if the person signing a check is the authorized person. Should an individual loose their wallet or purse having both their identification and their check book, any other person would be able to use their checks. It seems that the check itself should have a "built-in" mechanism for forgery control since this is lacking in general practise today. Finally, there is no way for a merchant or banker, other then the signature verification card held at the bank, to identify a check bearer. Should a check forger have access to another's personal identification and checks, the forger would have little problem in signing a check for any amount and cashing it at the bank of origin. It would appear that a check should have a "built-in" mechanism for proving the authenticity of the bearer, other than that fact that he holds the drivers license of the authorized person, and that his signature is similar to that of the authorized person.

Clearly, there is a need for an improved check book especially for consumer protection. Such a needed device is described in the following summary and detailed description and is based upon principles that are defined in the appended claims.

SUMMARY OF THE INVENTION

It is one objective of the present invention to provide an early warning of a missing check or checks taken from a check book. The check book of the present invention is bound with each following check displaced by a fraction of an inch to one side of the previous check in order that the check book holder can see the edge of each and every check in the book at a glance. Each following check contains a brightly colored stripe near the displayed edge, that is normally covered from view by the preceding check. When any check in the book is removed before the previous check, the stripe on the next check is uncovered thereby indicating the missing check. Therefore the present invention provides a means for early warning to the book holder that a check has been removed from the check book out of numerical sequence.

It is another objective of the present invention that the signature of the bearer of any one of the checks taken from the check book be verifiable by any merchant or vender to whom the check is presented. This objective has been achieved by providing a portion of the face of each check with an authentication signature of the check account holder, but printed in a form that is not normally visible. After the check has been signed by the bearer, it is then possible to render the authentication signature visible for comparison of both signatures in an attempt to prove the authenticity of the bearer. This approach makes it possible to cash checks without carrying personal identification and thus thwarts a forger who has access to the identification of another person.

It is a final objective of the present invention to provide a simple and cost effective means of identifying the authenticity of the bearer of a check taken from the check book in a manner separate from this signature. Each check has a series of symbols, typically letters or numbers printed on the face of the check, that would be marked in a manner, such as encircling a particular series of numbers or letters at the time of signing the check. Thus both the signature and the symbol coding function would provide identification of the bearer. Each account holder could provide several codes to the bank. These codes might include, first, an authenticating code that would communicate to a bank teller that the bearer and endorser of a presented check is the account holder. A second code might communicate to the bank teller that the bearer wishes for him to state that the balance will not cover the check. This might be used when the bearer is being forced under duress to cash a check for another. A third code could be used to communicate to the teller to alert bank security procedures or call the police, etc.

With traditional travelers checks, the bearers authenticating signature is typically written onto the face of the check, visible to a forger. An improvement includes replacing the visible authenticating signature with a simple hand printed name and adding an authenticating signature made with invisible ink or other non-visible method. The authenticating signature would then be rendered visible only after the check had been signed by the bearer. Where vendors and merchants do not have access to the simple means by which the signature might be rendered visible, the check bearer could carry such means in pocket or purse.

Other features and advantages of the present invention will become apparent from the following more detailed description, taken in conjunction with the accompanying drawings, that illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
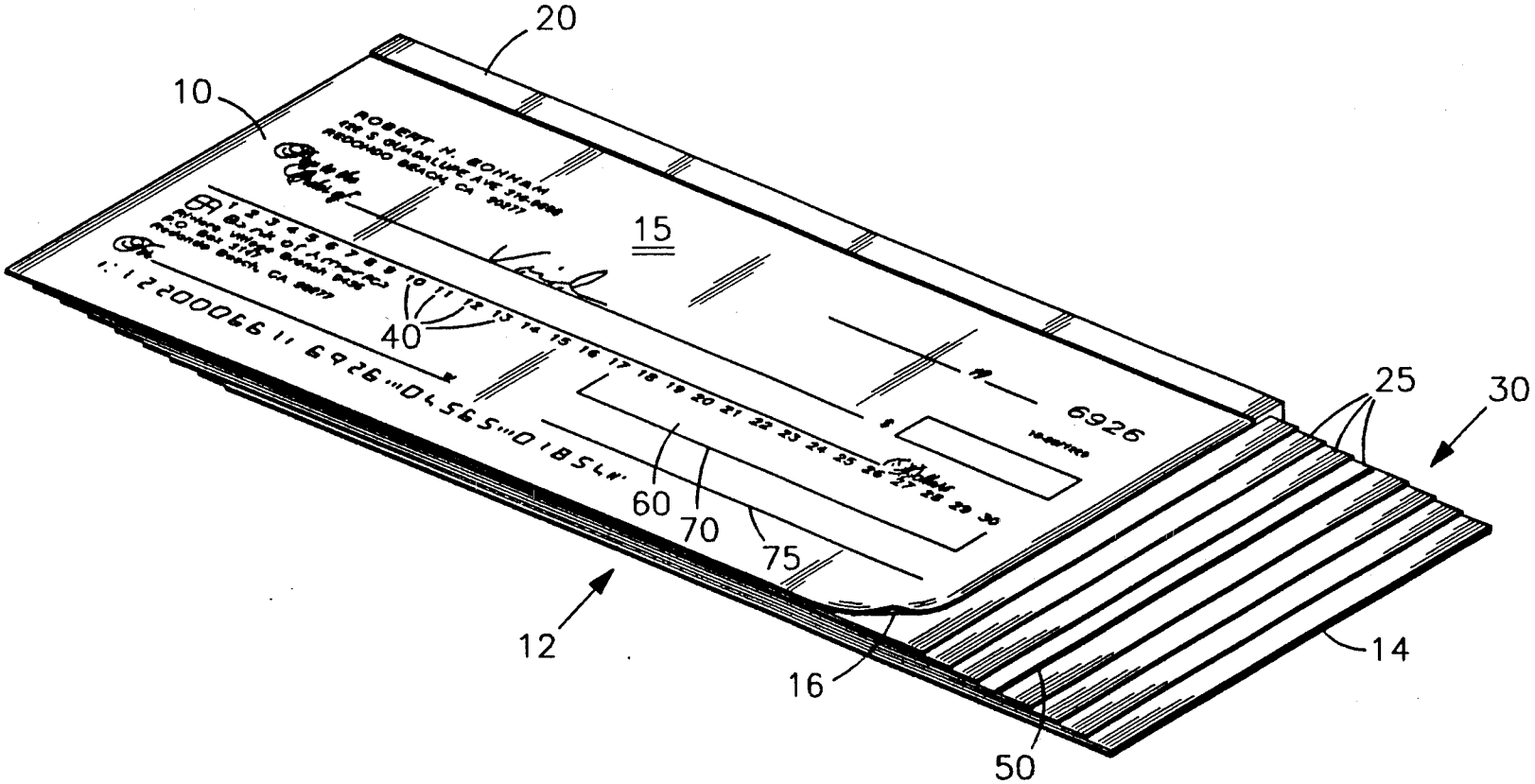
FIG. 1 is a perspective view illustration of the check book of the invention.
Figure 2:
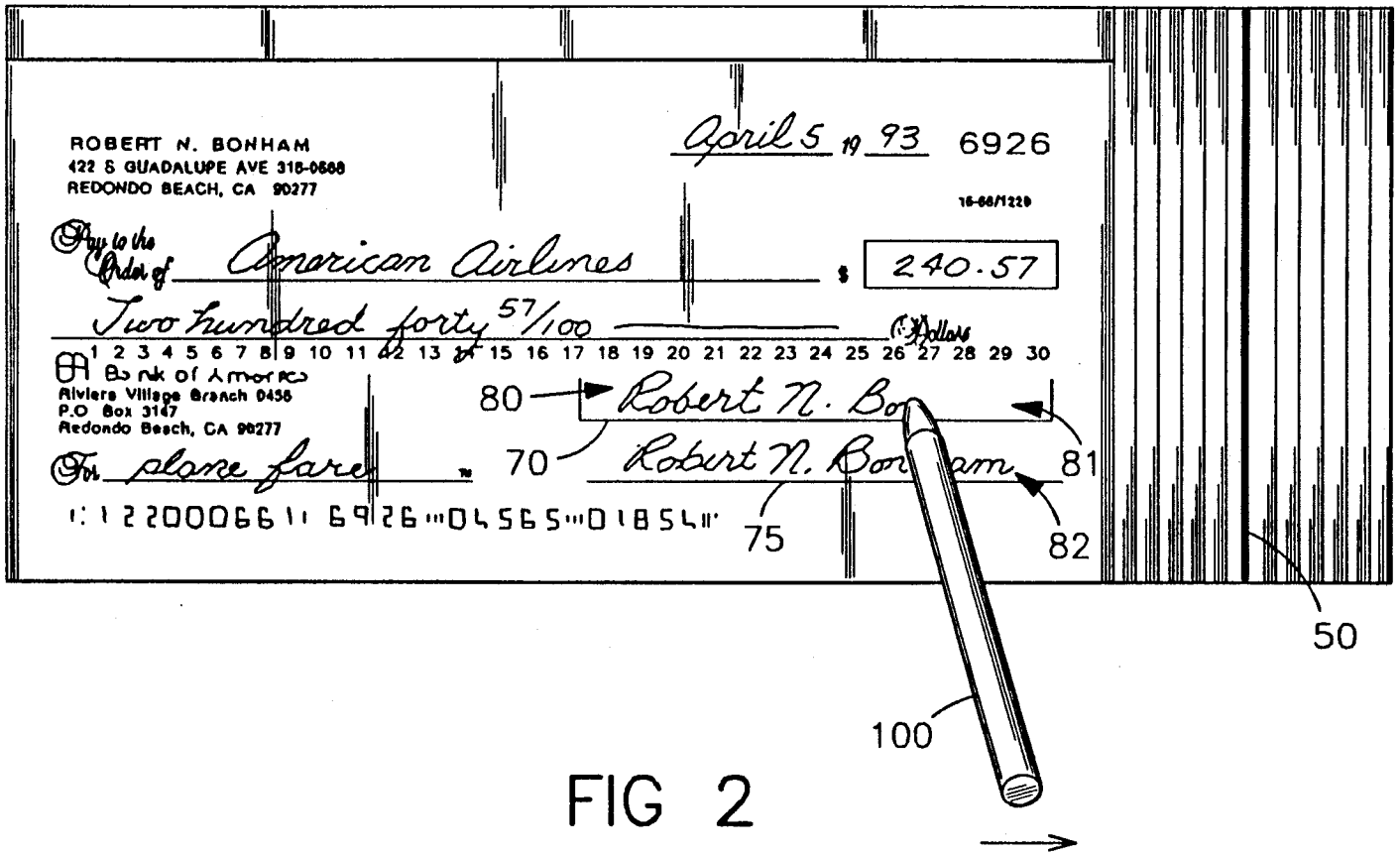
FIG. 2 is a plan view of the check book of FIG. 1 showing the invisible authenticating signature as it might be resolved.
Figure 3:
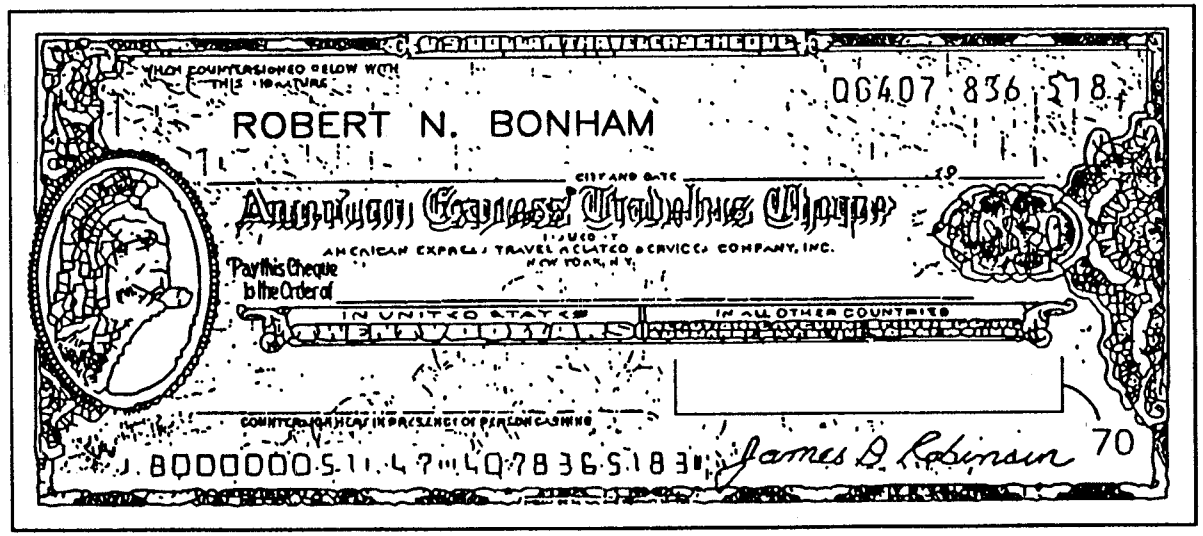
FIG. 3 is a plan view of a travelers type check using the invisible signature feature of the present disclosure.

FIGS. 1 and 2 illustrate a check book comprising a plurality of rectangular paper checks 10 each having a face 15 and a back 16. The back 16 of each preceding check 10 is in contact with the face 15 of each succeeding check 10 in a stack 12. All of the checks are typically removably bound in offset stacked alignment, by a binding means 20, such that a portion 25 of the face 15 of each check 10 is simultaneously visible when frontally viewed. In this way, the book holder can see, at least the edge of the face of each and every check in the book. Each check face 10 includes a marker stripe 50 printed close to the visible edge of the check 10, that is, adjacent to the portion 25, and this stripe is normally covered from view by each preceding check 10 such that if any check 10 is removed from the check book before the immediately preceding check 10, the stripe 50 of the check 10 immediately succeeding the removed check 10 will be uncovered so as to be rendered visible when frontally viewed, and thus visually indicate the missing check 10. This provides an early indication that a check has been removed from the stack out of order. Of course a stripe 50 is always normally visible in that each check 10 has one stripe 50. The removal of a check 10 before its preceding check 10 makes two of the stripes 50 visible, and it is this condition of two visible stripes that is the early warning of an unwarranted check 10 removal from the stack 12. The bottom check 10 in the stack 12 is followed by a deposit slip or a check book backing page 14 which has a stripe 50 located in a position whereby the removal of the last check 10 uncovers the stripe 50 on the backing page 14. This arrangement prevents the undiscovered removal of the final, or bottom check 10 from the stack 12. The construction of the stack 12 and the stripe 50 location results in early indication of the theft of a check 10 from the checkbook.

The figures further show that on the face 15 of each check 10 a plurality of alphanumeric symbols 40, such as a series of numerals arranged in linear order across the face 15, are provided. Typically, these symbols 40 are used as a means for thwarting forgery such that the execution of the check is planned to include selecting, by circling or otherwise marking, at least one of the symbols as a code known only to a proper executor of the check 10 and also to the recipient of the check 10, such as a bank, whereby both the executed signature as well as the marked symbols 40, appearing on the face 15 of the Check 10, may be compared to like signature and said symbols previously known to the recipient in judging the authenticity of the executor in that only the proper executor of the check 10 would know which of the symbols 40 should be marked or otherwise indicated. The code could include, in addition to selecting the proper numerals, for instance, the type of marking. As an example, the numerals 1, 3, and 14 might be selected for marking, and the method of indicating these might include encircling the numeral 1, writing an "X" over the numeral 3, and underlining or enclosing in a box, the number 14. Banks might provide account holders electronic access, controlled by PIN number, to a database storing the proper code. The code could be changed by the account holder at his whim in order to safeguard the security of the code system over time.

An additional means for assuring the authenticity of the bearer of a check 10 is an authenticating signature 80, deposited by writing or other means, on the face 15 of the check 10 in a normally non-visible material 81, but which is capable of later being easily rendered visible, such that after the execution of the check, the authenticating signature 80 may be rendered visible for comparison with the already executed signature 82 by the bearer. Since the bearer could not see the signature 80 prior to executing the check 10, the receiver of the check 10 can be reasonably assured that the bearer is, in fact the same person that executed the signature 80, if the two signatures are similar.

One such material for producing the authentication signature 80 is derived from a solution of potassium ferrocyanide. After drying, the authenticating signature 80 executed in the non-visible material 81, may be easily rendered visible by a solution of ferris sulphate. This could be achieved by wiping over the authenticating signature with a marker pen 100 filled with the indicator. Preferably an area 60 on the face 15 of the check 10 just above the signature line 75 would be identified by delineation such that the receiver of the check would know where to resolve the invisible authenticating signature 80. Preferably the delineation would include a U-shaped box outline 70.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A check book comprising a plurality of rectangular paper checks each having a face and a back, the back of each preceding said check in contact with the face of each succeeding said check, all removably bound in offset stacked alignment such that a portion of the face of each said check is simultaneously visible with the book frontally viewed, each said succeeding face including thereon a marker stripe normally covered from view by each said preceding check such that if any said succeeding check is removed from the check book before the immediately said preceding check, the stripe of that said check following the removed said check is rendered visible when frontally viewed, thus visually indicating the missing said removed check whereby theft of a check from the check book is early indicated.

2. The check book of claim 1 further including, on the face of each said check, a plurality of alphanumeric symbols provided as a means for thwarting forgery such that the execution of the check may include the selecting, by circling or otherwise marking, of at least one of the symbols as a code known only to a proper executor of the check and to the recipient of the check, such as a bank, whereby both an executed signature as well as the marked symbols, appearing on the face of the check, may be compared to like signature and said symbols previously known to the recipient in judging the authenticity of the executor.

3. The check book of claim 2 wherein the symbols constitute a series of numerals arranged in linear order across the face of each of the checks.

4. The check book of claim 2 further including, on the face of each said check, an authenticating signature, deposited in a normally non-visible material capable of later being rendered visible, such that after the execution of the check, the authenticating signature may be rendered visible for comparison with the executed signature.

5. The check book of claim 4 wherein the normally non-visible material is derived from a solution of potassium ferrocyanide, such that said material is rendered visible by a solution of ferris sulphate wiped over the authenticating signature.

6. The check book of claim 1 further including, on the face of each said check, an authenticating signature, deposited in a normally non-visible material capable of later being rendered visible, such that after the execution of the check, the authenticating signature may be rendered visible for comparison with the executed signature.

7. The check book of claim 6 wherein the normally non-visible material is derived from a solution of potassium ferrocyanide, such that said material is rendered visible by a solution of ferris sulphate wiped over the authenticating signature.

8. The check book of claim 6 further including on the face of each said check, an area marked by a series of lines for deposition of the authenticating signature such that it is known where to find the non-visible authenticating signature.

* * * * *